US005106016A

United States Patent [19]

Beckmann

[11] Patent Number: 5,106,016

[45] Date of Patent: Apr. 21, 1992

[54] MAILBOX COVER

[75] Inventor: Robert C. Beckmann, Vale, N.C.

[73] Assignee: McCalla/Lackey Corporation, Hickory, N.C.

[21] Appl. No.: 697,727

[22] Filed: May 3, 1991

Related U.S. Application Data

[62] Division of Ser. No. 462,075, Jan. 8, 1990, abandoned.

[51] Int. Cl.[5] ..... B65D 91/00

[52] U.S. Cl. ..... 232/17; 232/38

[58] Field of Search ..... 232/17, 38; 33/3 R, 33/197, 623

[56] References Cited

U.S. PATENT DOCUMENTS

| | | | |
|---|---|---|---|
| 4,244,512 | 1/1981 | Wise | 232/17 |
| 4,375,869 | 3/1983 | Hatch | 232/17 |
| 4,387,516 | 6/1983 | Laux | 33/3 R |
| 4,712,731 | 12/1987 | Gramelspacher | 232/17 |
| 4,913,212 | 4/1990 | Clavier | 160/105 |

*Primary Examiner*—Blair M. Johnson
*Attorney, Agent, or Firm*—Bailey & Hardaway

[57] ABSTRACT

A decorative mailbox cover adapted to fit a standard street mounted postal box wherein the decorative cover is formed of a flexible sheet, and wherein the cover provides for a cut out guide on its inner left side for the proper positioning of a slot to be fitted over the mailbox flag and adhesive strips positioned in a longitudinal direction along its inner edges for securing the cover to the mailbox.

2 Claims, 2 Drawing Sheets

MAILBOX COVER

This application is a division of application Ser. No. 07/462,075, filed Jan. 8, 1990 now abandoned.

BACKGROUND OF THE INVENTION

The present invention relates to an improvement in decorative mailboxes comprising a decorative mailbox cover which is easily installed and removed.

In the field relating to mailboxes, there have during recent years, been developed various constructions with a view toward providing a more decorative mailbox. A mailbox cover of the type set forth above represents a substantial advance in this field as it allows one to frequently change the mailbox design without replacing the mailbox and to do so with relative ease.

SUMMARY OF THE INVENTION

An object of the invention is to further develop the field of decorative mailboxes wherein any mailbox of a standard type may be provided with a decorative cover, which will fit over the top and sides of the box and which is easily installed and replaced.

For the achievement of the above mentioned objects there is provided a decorative mailbox cover, wherein, according to the invention, the cover is comprised of a flexible material, the cover contains a cutout guide printed on its inner left side to ensure the proper positioning of a slot to be cut out of the cover enabling the cover to fit over the flag of the mailbox, and adhesive strips positioned longitudinally along the inner edges of the cover such that the strips provide means for securely attaching the decorative cover to a standard mailbox.

DETAILED DESCRIPTION

Figure 1:
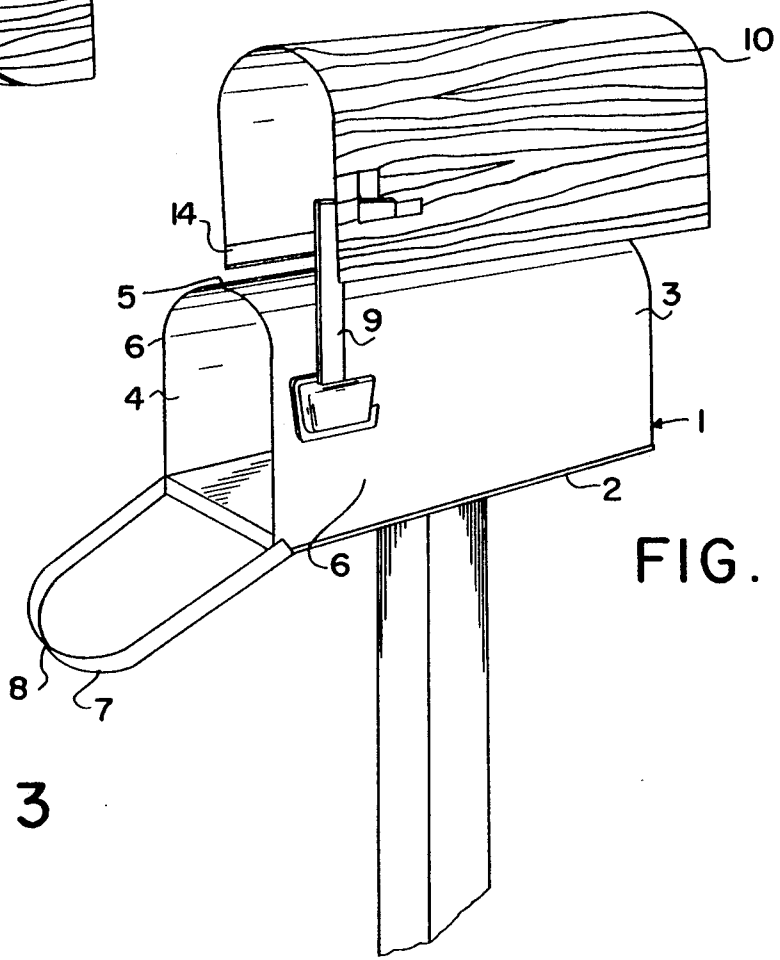
FIG. 1 is a perspective view of a mailbox showing the manner in which the decorative mailbox cover is mounted thereon.

As it appears form the drawings, the mailbox shown in FIG. 1 is a standard street mounted postal box comprised of a delivery box 1 having a bottom 2, an end wall at one end thereof 3, an opening 4 at the end opposite the end wall 3, a generally arcuate top 5 extending downward to bottom 2 forming sides 6, a door 7 hingedly mounted to the bottom 2 at the open end 4, having a latching means 8 attached to the door 7 for securing the door in its closed position, and a flag 9 mounted to one of the sides.

As is illustrated in FIG. 1, the decorative cover 10 is fitted over the top 5 of the mailbox and the flag 9 is slipped through a slot 2 cut into the side of said cover.

Figure 2:
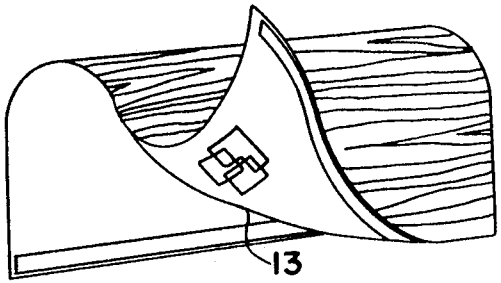
FIG. 2 is a perspective view of the mailbox cover showing a cut out guide printed on the inner left side for proper positioning of the slot.

FIG. 2 illustrates how the size of the slot 2 is determined from the cut out guide 13 printed on the inside of the decorative cover.

As shown in FIG. 1, the mailbox cover also contains adhesive strips 14 positioned along its inside edges providing a means for securely attaching the cover 10 to the box 1. And, FIG. 3 shows the decorative cover correctly in place.

Figure 3:
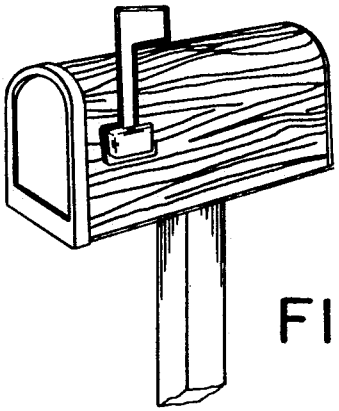
FIG. 3 is a perspective view of the mailbox and decorative mailbox cover of FIG. 1 with the decorative cover in place.
Figure 4:
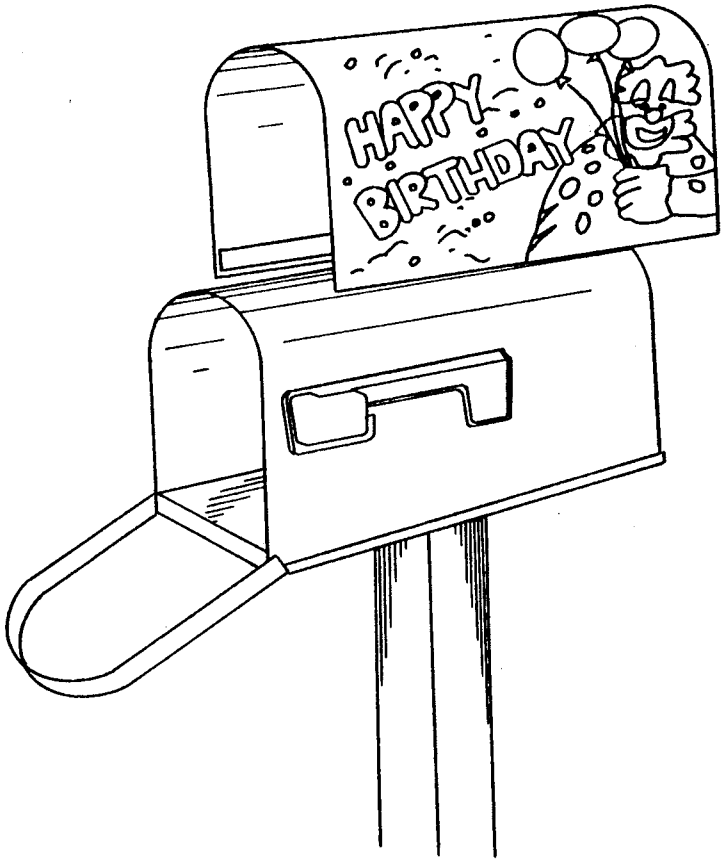
FIG. 4 is a perspective view of a disposable, decorative mailbox cover.

The decorative mailbox cover of the invention is particularly adopted to be used with any standard street mounted postal box, such as that shown in FIGS. 1, 3, and 4. One embodiment of the decorative cover is formed as a flexible sheet which displays a decorative design. These sheets may be formed of various flexible materials such as vinyl. Another embodiment of the invention is a disposable decorative cover which is formed as a flexible waited paper adapted to receive various printed messages attached thereto via adhesive strips.

While a specific embodiment of the invention has been described and illustrated, it should be clear that the described invention may be modified in several respects, and as many variations will become apparent to those of skill in the art from a reading of the above description, which is exemplary in nature, such variations and modifications are embodied within the spirit and scope of this invention as defined by the following appended claims.

That which is claimed:

1. The process of decorating an existing mailbox comprising the steps of:

said existing mailbox having a standard street mounted postal box having;

a bottom;

an end wall at one end thereof;

an opening at the end opposite the end wall;

a generally arcuate top extending downwardly to said bottom forming sides;

a door hingedly mounted to the bottom at said open end, said door having a latching means attached thereto for securing said door in a closed position; and a flag mounted to one of said sides of said box;

providing a decorative cover comprising;

a cutout guide printed on an inner side of said cover; and adhesive strips positioned along inner edges of said cover;

cutting a slot in said cover so that said cover fits over said flag during installation;

placing said cover over said mailbox by slipping said flag through said slot cut in said cover; and adhering said adhesive strips to securely attach said cover to said mailbox.

2. The process according to claim 1 wherein said decorative mailbox cover is formed of a generally flexible sheet having a shape conforming to that of said mailbox and wherein said step of placing comprises flexing said cover.

* * * * *